US007574157B2

(12) United States Patent
Ishikawa

(10) Patent No.: US 7,574,157 B2
(45) Date of Patent: Aug. 11, 2009

(54) IMAGE FORMATION DEVICE WITH AUXILIARY ROLLER

(75) Inventor: Tadashi Ishikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 403 days.

(21) Appl. No.: 11/514,129

(22) Filed: Sep. 1, 2006

(65) Prior Publication Data

US 2007/0183809 A1 Aug. 9, 2007

(30) Foreign Application Priority Data

Feb. 6, 2006 (JP) ..... 2006-028386

(51) Int. Cl.
*G03G 15/02* (2006.01)

(52) U.S. Cl. ..... 399/100; 399/176

(58) Field of Classification Search ..... 399/100, 399/168, 174, 176
See application file for complete search history.

(56) References Cited

U.S. PATENT DOCUMENTS

| | | | | |
|---|---|---|---|---|
| 5,805,962 | A | 9/1998 | Ko | |
| 7,460,810 | B2 * | 12/2008 | Sampe et al. | 399/100 |
| 7,463,845 | B2 * | 12/2008 | Suda et al. | 399/176 |

FOREIGN PATENT DOCUMENTS

| | | | |
|---|---|---|---|
| CN | CN2575719 | Y | 9/2003 |
| JP | A-2-272589 | | 11/1990 |
| JP | A-2-272594 | | 11/1990 |
| JP | 8-95350 | A | 4/1996 |
| JP | 08-335023 | A | 12/1996 |
| JP | 11-065302 | | 3/1999 |
| JP | 2000-206805 | | 7/2000 |
| JP | 2003-165662 | | 6/2003 |

* cited by examiner

*Primary Examiner*—William J Royer
(74) *Attorney, Agent, or Firm*—Morgan, Lewis & Bockius LLP

(57) ABSTRACT

An image formation device includes an image-bearing body that rotates, a charging roller that contacts the image-bearing body and is rotated by the rotation of the image-bearing body, and charges the image-bearing body, a cleaning roller that contacts the charging roller and is rotated by the rotation of the charging roller, and cleans the charging roller, and a first auxiliary roller that is provided coaxially with the charging roller, contacts the image-bearing body and is rotated by the rotation of the image-bearing body. The image formation device satisfies the following relation:

$$F1>F2>F3$$

where F1 represents a friction force between the first auxiliary roller and the image-bearing body, F2 represents a friction force between the image-bearing body and the charging roller and F3 represents a friction force between the charging roller and the cleaning roller.

13 Claims, 6 Drawing Sheets

IMAGE FORMATION DEVICE WITH AUXILIARY ROLLER

BACKGROUND

1. Technical Field

The present invention relates to an image formation device such as a photocopier, a printer or the like which employs an electrophotographic system, and more particularly relates to an image formation device which includes a contact charging-type charging roller and a cleaning member of the charging roller, the charging roller rotating and contacting an image-bearing body which is driven to rotate and electrostatically charging a surface of the image-bearing body.

2. Related Art

In recent years, as charging apparatuses for image formation devices such as photocopiers, printers and the like which employ electrophotographic systems, in order to facilitate reductions in ozone emissions, reductions in device sizes, reductions of costs of high-power supplies and so forth, bias charge rollers (BCR) which contact or are disposed close to image-bearing bodies have been employed instead of conventional non-contact-type chargers such as scorotrons and the like.

In a charging apparatus with such a non-contact type charging system, because the charging roller constantly contacts the image-bearing body, there is a problem in that soiling tends to occur because of adherence of extraneous matter to the surface of the charging roller. The image-bearing body repeatedly performs an image formation operation. At a downstream side from a transfer stage, the surface of the image-bearing body passes through a cleaning stage, which removes extraneous matter such as residual toner after transfer and the like, and then advances into a region of a charging stage. However, even though the surface has passed through the cleaning stage, particles which are finer than the toner, such as bits of the toner, external additives of the toner and the like, remain on the image-bearing body rather than being cleaned, and adhere to the surface of the charging roller. The extraneous matter that adheres to the surface of the charging roller causes variations in surface resistance values of the charging roller. Thus, unusual charging, unstable charging and the like occur, and charging uniformity deteriorates.

SUMMARY

According to an aspect of the present invention, an image formation device includes an image-bearing body that rotates, a charging roller that contacts the image-bearing body and is rotated by the rotation of the image-bearing body, and charges the image-bearing body, a cleaning roller that contacts the charging roller and is rotated by the rotation of the charging roller, and cleans the charging roller, and a first auxiliary roller that is provided coaxially with the charging roller, contacts the image-bearing body and is rotated by the rotation of the image-bearing body. The image formation device satisfies the following relation:

$$F1>F2>F3$$

where F1 represents a friction force between the first auxiliary roller and the image-bearing body, F2 represents a friction force between the image-bearing body and the charging roller and F3 represents a friction force between the charging roller and the cleaning roller.

BRIEF DESCRIPTION OF THE DRAWINGS

Exemplary embodiments of the present invention will be described in detail based on the following figures, in which.

DETAILED DESCRIPTION

Hereinbelow, an image formation device relating to an exemplary embodiment of the present invention will be described with reference to the drawings.

Figure 1:
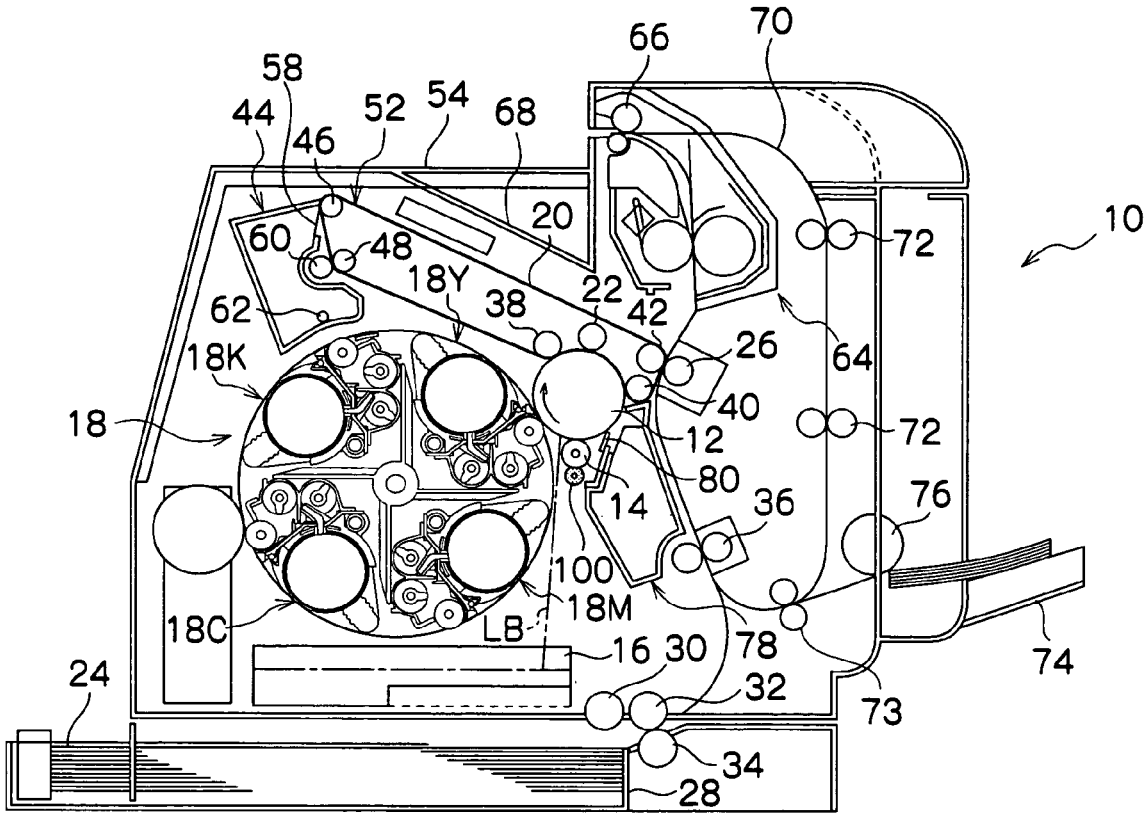
FIG. 1 is a structural view showing the general structure of an image formation device according to an embodiment of the present invention.

An image formation device 10 of the present embodiment, which is shown in FIG. 1, is a four cycle-type full-color laser printer. As shown in FIG. 1, a photosensitive drum 12 is provided inside the device 10, slightly upward and to the right of the middle of the device 10, to be rotatable. As this photosensitive drum 12, for example, a conductive cylindrical body whose surface is covered with a photosensitive layer formed of OPC or the like is employed, and the photosensitive drum 12 is driven to rotate in the direction of the arrow at a predetermined processing speed by an unillustrated motor.

A surface of the photosensitive drum 12 is electrostatically charged to a predetermined potential by a charging roller 14, which is disposed substantially directly below the photosensitive drum 12. Then, image exposure is implemented by a laser beam LB, from an exposure apparatus 16 which is disposed below the charging roller 14, and an electrostatic latent image is formed in accordance with image information.

The electrostatic latent image that has been formed on the photosensitive drum 12 is developed by a rotating developing unit 18, in which developers 18Y, 18M, 18C and 18K for the colors yellow (Y), magenta (M), cyan (C) and black (K), respectively, are arranged along a circumferential direction, to form a toner image of a predetermined color.

Here, the respective stages of charging, exposure and development of the surface of the photosensitive drum 12 are repeated a predetermined number of times, in accordance with colors of an image that is to be formed. For the development stage, the rotating developing unit 18 turns and the developing unit 18Y, 18M, 18C or 18K of a corresponding color is moved to a development position facing the photosensitive drum 12.

For example, in a case of forming a full-color image, the respective stages of charging, exposure and development are repeated four times on the surface of the photosensitive drum 12, in correspondence with each of the colors yellow (Y), magenta (M), cyan (C) and black (K), and toner images corresponding to the respective colors yellow (Y), magenta (M), cyan (C) and black (K) are sequentially formed on the surface of the photosensitive drum 12. A number of rotations through which the photosensitive drum 12 turns for the formation of the toner image differs depending on the size of the image. For example, for A4 size, a single image is formed by the photosensitive drum 12 turning through three rotations. That is, over three turns of the photosensitive drum 12, toner images corresponding to the colors yellow (Y), magenta (M), cyan (C) and black (K) are formed at the surface of the photosensitive drum 12.

The toner images of the colors yellow (Y), magenta (M), cyan (C) and black (K) that are sequentially formed on the photosensitive drum 12 are transferred by a primary transfer roller 22 at a primary transfer position, at which an intermediate transfer belt 20 is wound around an outer periphery of the photosensitive drum 12, with conditions such that the toner images are mutually superposed on the intermediate transfer belt 20.

The toner images of yellow (Y), magenta (M), cyan (C) and black (K) which have been transferred onto the intermediate transfer belt 20 are transferred, all at once, by a secondary transfer roller 26 onto recording paper 24, which is supplied with a predetermined timing.

Meanwhile, the recording paper 24 is fed out by a pickup roller 30 from a paper supply cassette 28, which is disposed at a lower portion of the image formation device 10, and the recording paper 24 is supplied, by a feeding roller 32 and a retarding roller 34, in a state in which one sheet at a time is being handled. The recording paper 24 is conveyed to a secondary transfer position at the intermediate transfer belt 20, having been synchronized, by a registration roller 36, with the toner image that has been transferred onto the intermediate transfer belt 20.

The intermediate transfer belt 20 spans between a wrap-in roller 38, the primary transfer roller 22, a wrap-out roller 40, a backup roller 42, a first cleaning backup roller 46 and a second cleaning backup roller 48, with a predetermined tension. The wrap-in roller 38 defines a wrapping position of the intermediate transfer belt 20 at an upstream side, in a direction of turning, of the photosensitive drum 12. The primary transfer roller 22 transfers a toner image formed on the photosensitive drum 12 onto the intermediate transfer belt 20. The wrap-out roller 40 defines a wrapping position of the intermediate transfer belt 20 at a downstream side of the wrapping position of the wrap-in roller 38. A backup roller 42 abuts against the secondary transfer roller 26 with the intermediate transfer belt 20 therebetween. The first cleaning backup roller 46 and the second cleaning backup roller 48 oppose a cleaning apparatus 44 of the intermediate transfer belt 20. The intermediate transfer belt 20 is driven in accordance with, for example, rotation of the photosensitive drum 12 so as to circulatingingly turn at a predetermined processing speed.

Herein, in order to facilitate a reduction in size of the image formation device 10, the intermediate transfer belt 20 is structured such that a cross-sectional form in which the intermediate transfer belt 20 stretches is a flat, long, thin, substantially trapezoid shape.

The intermediate transfer belt 20 integrally structures an image formation unit 52 with the photosensitive drum 12, the charging roller 14, the intermediate transfer belt 20, the plural rollers 22, 38, 40, 42, 46 and 48 between which the intermediate transfer belt 20 spans, the cleaning apparatus 44 for the intermediate transfer belt 20, and a cleaning apparatus 78 for the photosensitive drum 12, which will be described later. It is possible to remove the whole image formation unit 52 from the image formation device 10, by opening a top cover 54 of the image formation device 10 and manually lifting up a handle (not shown) which is provided at an upper portion of the image formation unit 52.

The cleaning apparatus 44 of the intermediate transfer belt 20 is provided with a scraper 58 and a cleaning brush 60. The scraper 58 is disposed so as to abut against the surface of the intermediate transfer belt 20 that is stretched against the first cleaning backup roller 46, and the cleaning brush 60 is disposed so as to abut against the surface of the intermediate transfer belt 20 that is stretched against the second cleaning backup roller 48. Residual toner, paper dust and the like is removed by the scraper 58 and the cleaning brush 60, and is recovered to an interior portion of the cleaning apparatus 44.

The cleaning apparatus 44 is a structure which is provided to be capable of swinging in the anti-clockwise direction of FIG. 1, about a swinging shaft 62. Until secondary transfer of a final color toner image is complete, the cleaning apparatus 44 is withdrawn to a position which is separated from the surface of the intermediate transfer belt 20, and when the secondary transfer of the final color toner image is complete, the cleaning apparatus 44 abuts against the surface of the intermediate transfer belt 20.

The recording paper 24 to which a toner image has been transferred from the intermediate transfer belt 20 is conveyed to a fixing apparatus 64 and is heated and pressured by this fixing apparatus 64. Thus, the toner image is fixed onto the recording paper 24. Thereafter, in a case of single-sided printing, the recording paper 24 to which the toner image has been fixed is simply ejected, by an ejection roller 66, to an ejection tray 68 which is provided at an upper portion of the image formation device 10.

On the other hand, in a case of double-sided printing, the recording paper 24, to a first face (front face) of which the toner image has been fixed by the fixing apparatus 64, is not simply ejected to the ejection tray 68 by the ejection roller 66. In a state in which a trailing end portion of the recording paper 24 has been nipped by the ejection roller 66, the ejection roller 66 is rotated in reverse, and a conveyance path of the recording paper 24 is switched to a duplex paper conveyance path 70. The recording paper 24 is inverted, front to back, by conveyance rollers 72 which are provided at this duplex paper conveyance path 70. In this state, the recording paper 24 is again conveyed to the secondary transfer position of the intermediate transfer belt 20, and a toner image is transferred onto a second face (rear face) of the recording paper 24. Then, the toner image at the second face (rear face) of the recording paper 24 is fixed by the fixing apparatus 64, and the recording paper 24 is ejected to the ejection tray 68.

Furthermore, optionally, a manual feeding tray 74 can be openably/closeably mounted at the image formation device 10, at a side face of the image formation device 10. The recording paper 24, of arbitrary size and type, which is placed on the manual feeding tray 74, is supplied by a paper supply roller 76 and is conveyed, via a conveyance roller 73 and the registration roller 36, to the secondary transfer position of the intermediate transfer belt 20. Thus, it is possible to form images on the recording paper 24 with arbitrary sizes and types.

In each turn of the photosensitive drum 12, after the stage of transfer of the toner image has been completed, residual toner, paper dust and the like at the surface of the photosensitive drum 12 is removed by a cleaning blade 80 of the cleaning apparatus 78, which is disposed diagonally below the photosensitive drum 12, and the surface is provided to the stage of formation of the next image.

Figure 2:
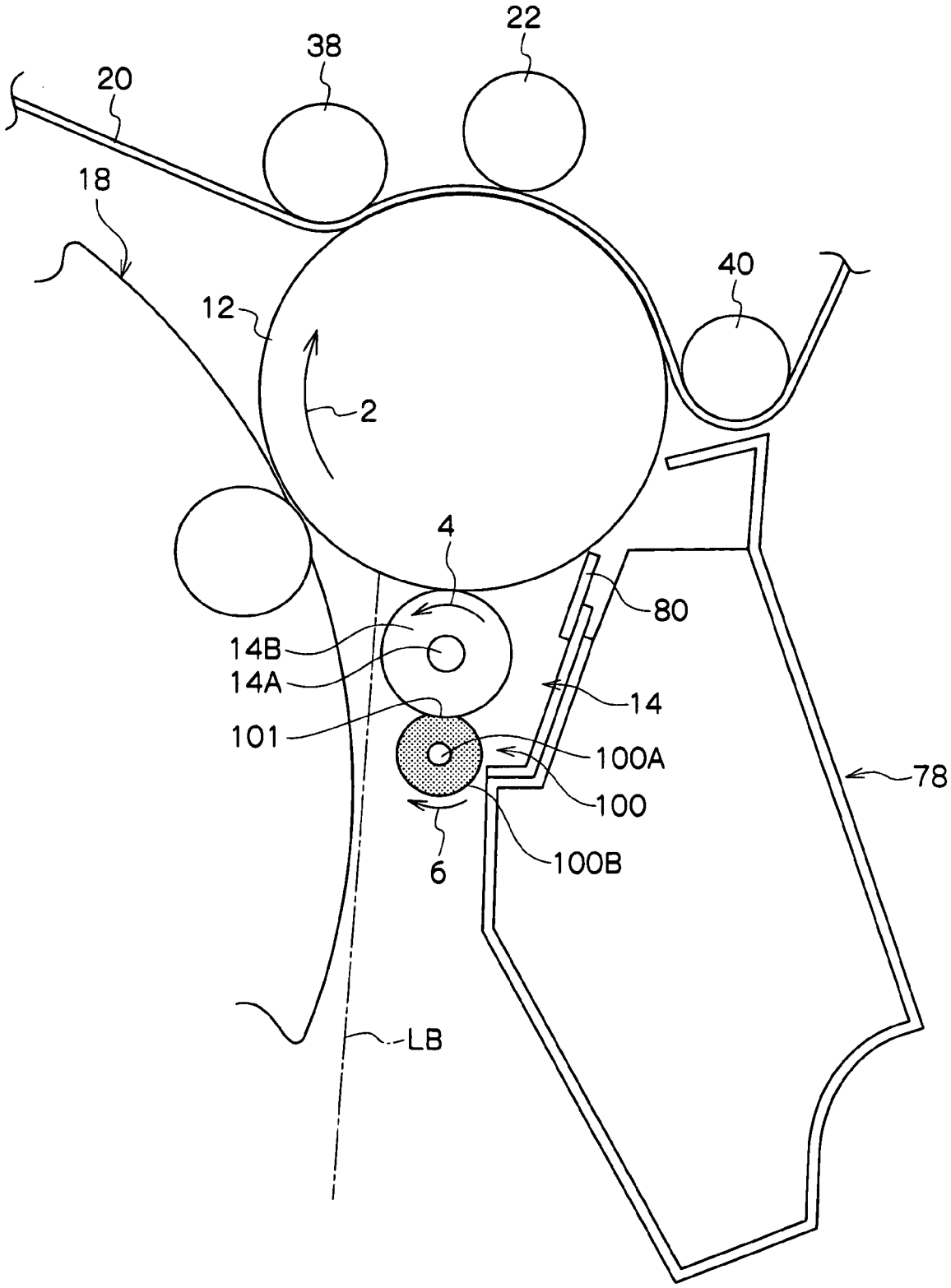
FIG. 2 is an enlarged view showing the structure of a photosensitive drum, a charging roller and a cleaning roller which are installed in the image formation device of FIG. 1.

As shown in FIG. 2, the charging roller 14 is disposed so as to touch the photosensitive drum 12, at a lower end portion of the photosensitive drum 12. At the charging roller 14, a charging layer 14B is formed around a conductive shaft 14A, and the shaft 14A is axially supported to be rotatable. At a lower end portion of the charging roller 14, at a side thereof which is opposite from the side thereof at which the photosensitive drum 12 is disposed, a cleaning roller 100 is provided. The cleaning roller 100 is a roller-form cleaning member which contacts the surface of the charging roller 14. At this cleaning roller 100, a sponge layer 100B is formed around a shaft 100A, and the shaft 100A is axially supported to be rotatable.

The cleaning roller 100 presses against the charging roller 14 with a predetermined loading, and the sponge layer 100B resiliently deforms along the periphery of the charging roller 14 and forms a nipping portion 101. The photosensitive drum 12 is driven to rotate in a clockwise direction of FIG. 2 (the direction of arrow 2) by an unillustrated motor, and the charging roller 14 is rotated in the direction of arrow 4 in accordance with the rotation of the photosensitive drum 12. Further, the roller-form cleaning roller 100 is rotated in the direction of arrow 6 in accordance with the rotation of the charging roller 14.

When the cleaning roller 100 is rotated, contamination such as toner and surface additives (extraneous matter) that has adhered to the surface of the charging roller 14 is cleaned off by the cleaning roller 100. Hence, this extraneous matter is taken into cells of a foam structure of the cleaning roller 100. The extraneous matter accommodated in the cells agglomerates and, when the extraneous matter reaches a suitable size, is returned from the cleaning roller 100 to the photosensitive drum 12 via the charging roller 14, and is recovered by the cleaning apparatus 78 which cleans the photosensitive drum 12. Thus, continuous maintenance of cleaning characteristics is realized.

Now, the charging roller 14 and the cleaning roller 100 of the present embodiment will be described.

The charging roller 14 is disposed in contact with the surface of the photosensitive drum 12 as described above and a DC voltage, or an AC voltage on a DC voltage, is applied thereto. Thus, the surface of the photosensitive drum 12 is electrostatically charged. A form of the charging roller 14 may be a roller form in which a resistive resilient layer constituting the charging layer 14B is formed around a core which constitutes the shaft 14A. The resistive resilient layer may have a structure which is divided into a sequence, from an outer side, of a resistive layer and a resilient layer which supports the resistive layer. Further, in order to provide the charging roller 14 with endurance and soiling resistance, it is possible, in accordance with requirements, to provide a protective layer at the outer side of the resistive layer.

Hereinbelow, a case in which a resilient layer, a resistive layer and a protective layer are provided on the core will be described in more detail.

Because a material of the core is to exhibit conductivity, ordinarily, iron, copper, brass, stainless steel, aluminum, nickel or the like is employed. Of materials other than metals, a material can be employed as long as it exhibits conductivity and suitable stiffness. For example, a resin-molded product in which conductive particles or the like are dispersed, or a ceramic or the like may be employed. Furthermore, besides the roller form, a hollow pipe form is possible.

As a material of the resilient layer, because the material is to exhibit conductivity or semiconductivity, the material is ordinarily a material in which conductive particles or semiconductive particles are dispersed in a resin material or a rubber material. As a resin material, a combined resin of polyester resin, acrylic resin, melamine resin, epoxy resin, urethane resin, silicon resin, urea resin, polyamide resin or the like, or the like is employed. As a rubber material, ethylene propylene rubber, polybutadiene, natural rubber, polyisobutylene, chloroprene rubber, silicon rubber, urethane rubber, epichlorhydrine rubber, fluorosilicone rubber, ethylene oxide rubber or the like, or a foam material in which such a rubber is foamed, is employed.

As the conductive particles or semiconductive particles, carbon black, a metal such as zinc, aluminium, copper, iron, nickel, chromium, titanium or the like, a metal oxide such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $Sb_2O_3$, $In_2O_3$, ZnO, MgO or the like, or an ionic compound such as a quarternary ammonium salt or the like, or another similar material can be employed. These materials may be employed singly or in a combination of two or more thereof. Furthermore, in accordance with requirements, an inorganic packing material such as talc, alumina, silica or the like, or an organic packing material such as a fluorine resin, microparticles of silicon rubber or the like, can be used singly or in a combination of two or more.

For the resistive layer and the protective layer, with a material in which conductive particles or semiconductive particles are dispersed in a settled resin to control resistance, resistivity may be set to $10^3$ to $10^{14}$ Ω·cm, preferably $10^5$ to $10^{12}$ Ω·cm, and more preferably $10^7$ to $10^{12}$ Ω·cm. A layer thickness may be 0.01 to 1000 μm, preferably 0.1 to 500 μm, and more preferably 0.5 to 100 μm. As the settled resin, an acrylic resin, cellulose resin, polyamide resin, methoxymethylated nylon, ethoxymethylated nylon, polyurethane resin, polycarbonate resin, polyester resin, polyethylene resin, polyvinyl resin, polyarylate resin, polythiophene resin, polyolefin resin such as PFA, FEP, PET or the like, styrene butadiene resin, melamine resin, epoxy resin, urethane resin, silicon resin, urea resin or the like is employed.

As the conductive particles or semiconductive particles, similarly to the resilient layer, carbon black, metals, metal oxides, ionic compounds such as quarternary ammonium salts and the like which exhibit ion conductivity, and the like can be employed singly or in a combination of two or more. Furthermore, in accordance with requirements, an oxidation inhibitor such as a hindered phenol, hindered amine or the like, an inorganic packing material such as a clay, kaolin, talc, silica, alumina or the like, an organic packing material such as a fluorine resin, microparticles of silicon rubber or the like, a lubricant such as silicone oil or the like, and another similar material can be added singly or in combinations of two or more. Moreover, a surfactant, a charging control agent and the like are added in accordance with requirements.

As a method for forming these layers, a blade coating process, a Meyer bar coating process, a spray coating process, an immersion coating process, a bead coating process, an air knife coating process, a curtain coating process or the like can be employed.

The cleaning roller 100 is formed from a core, which constitutes the shaft 10A, and a porous resilient layer, which constitutes the sponge layer 100B and which is formed at a peripheral surface of the core, and as described above, the cleaning roller 100 is disposed to contact the surface of the charging roller 14.

As a material of the core, a material which supports the porous resilient layer and exhibits stiffness to a degree capable of maintaining the state of contact with the charging roller 14 with a suitable abutting force is employed. Ordinarily, a metal such as iron, copper, brass, stainless steel, aluminium, nickel or the like, or alternatively a resin-molded product, a ceramic or the like, or such a material in which conductive particles or the like are dispersed, or a material in which an inorganic filler is dispersed or the like may be employed. Furthermore, besides the roller form, a hollow pipe form is possible.

The porous resilient layer is a roller-form sponge, which is formed with a predetermined cell density. For example, an ether-based urethane foam, polyethylene foam, polyolefin foam, melamine foam, micropolymer or the like can be employed.

Taking a polyurethane foam as an example and briefly describing a fabrication method thereof, the foam is fabricated using a polyol, an isocyanate, water, a catalyst (an amine catalyst, a metallic catalyst or the like) and a foam stabilizer (a surfactant), and additives such as a pigment and the like are employed in accordance with an intended application. When these ingredients are mixed and stirred, chemical reactions occur and a foam body of urethane resin can be obtained.

Next, a support structure for the charging roller 14 and cleaning roller 100 relating to the present exemplary embodiment, and auxiliary rollers which are provided at each of the rollers 14 and 100, will be specifically described.

Figure 3:
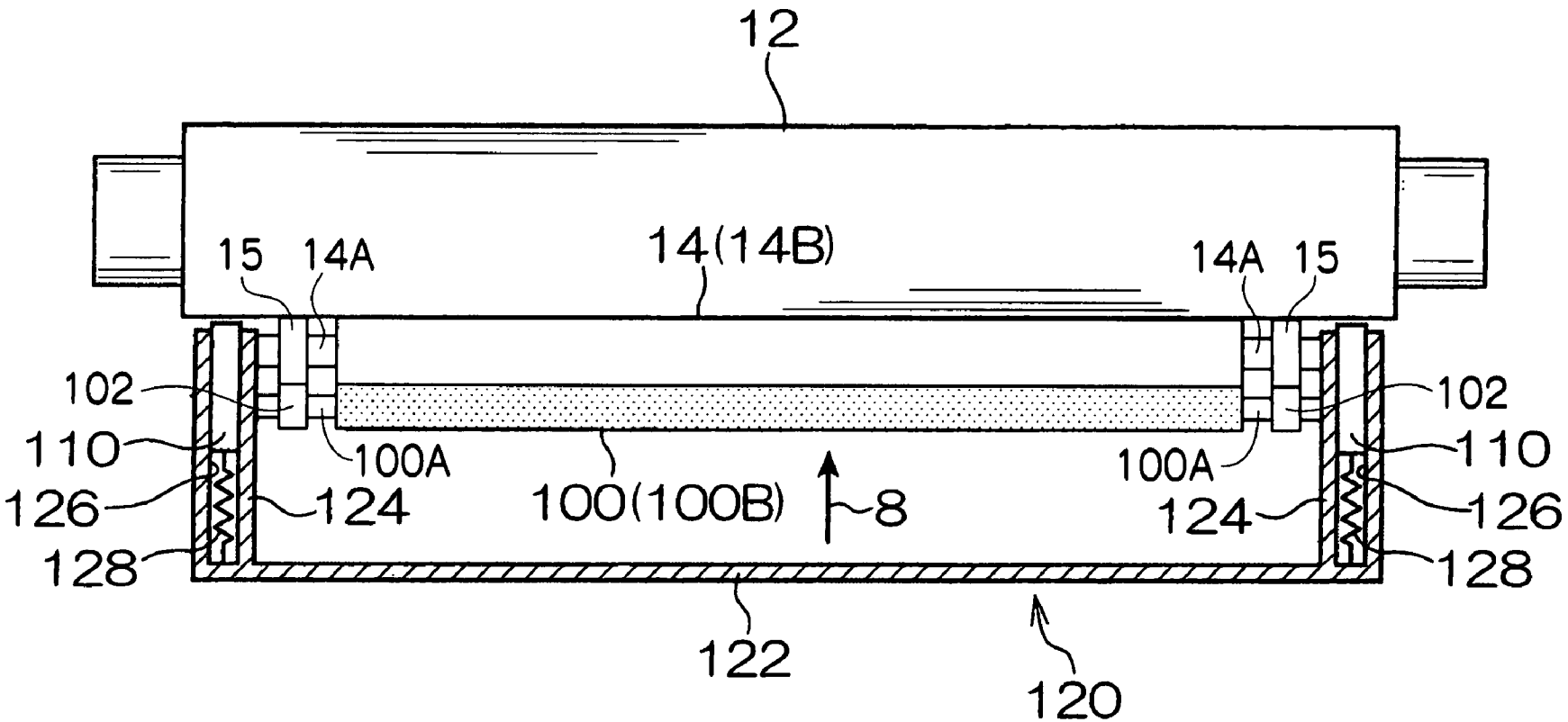
FIG. 3 is a partial sectional side view showing the structure of the photosensitive drum, the charging roller, the cleaning roller, auxiliary rollers and a holder according to the embodiment of the present invention.

As shown in FIG. 3, in the present exemplary embodiment, the charging roller 14 and the cleaning roller 100 are mounted at a box-like holder 120, via a pair of bearing members 110. The charging roller 14 and cleaning roller 100 are accommodated in this holder 120 and formed as a unit with the holder 120, and are disposed at predetermined positions relative to the photosensitive drum 12.

Figure 4:
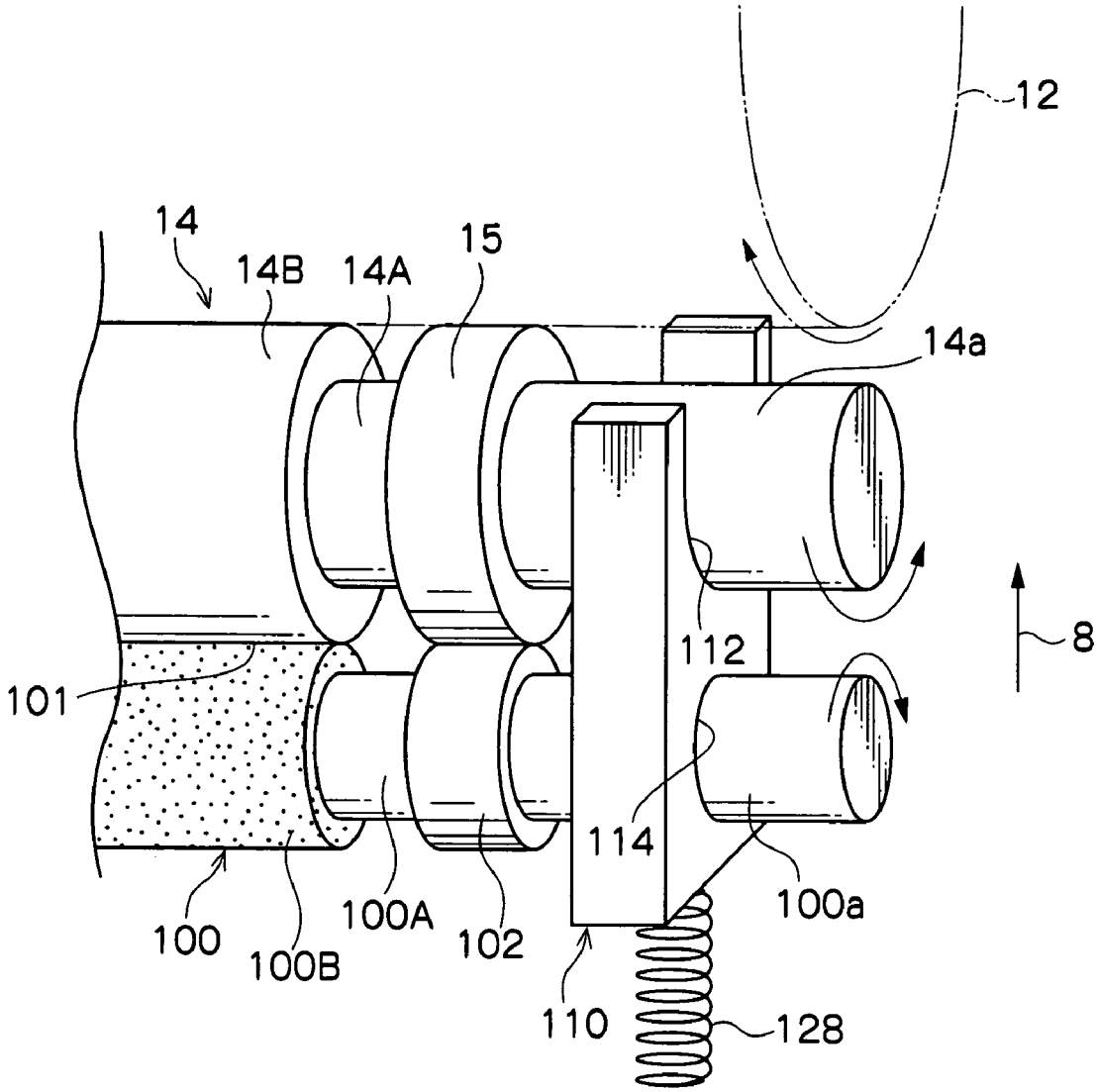
FIG. 4 is a perspective view showing a state in which the charging roller and the cleaning roller according to the embodiment of the present invention are axially supported at a bearing member.

As shown in FIG. 4, one of the bearing members 110 is formed in a cuboid shape (a block shape) and has a simple structure. The bearing member 110 is formed with a synthetic resin material, such as polyacetal, polycarbonate or the like, which has high stiffness and high slidability and is excellent in abrasion resistance. In order to further raise the abrasion resistance, the bearing member 110 may include glass fibers, carbon fibers or the like in the synthetic resin material.

A bearing trough 112 and a bearing hole 114, which are arranged with a predetermined spacing along a length direction of the bearing member 110 (the vertical direction of FIG. 4) are formed in the bearing member 110. The bearing trough 112 is formed with a 'U'-shaped cross section, which opens out at an upper end face of the bearing member 110. An internal diameter of an inner periphery face portion of the bearing trough 112, which has the form of a semi-circular periphery face, is substantially the same as a shaft diameter of a support portion 14*a*, which is provided at an end portion of the shaft 14A of the charging roller 14. The support portion 14*a* of the shaft 14A of the charging roller 14 is rotatably fitted into this bearing trough 112. Because the photosensitive drum 12 side of the bearing trough 112, which is the upper side thereof in the drawing, is open, when the support portion 14*a* is abuttingly supported at the inner periphery face portion of the bearing trough 112, a shape is formed in which a degree of freedom is provided to an abutting direction of the support portion 14*a* toward the photosensitive drum 12 (the direction of arrow 8). Meanwhile, a support portion 100*a* which is provided at an end portion of the shaft 100A of the cleaning roller 100 is rotatably inserted into the bearing hole 114.

As shown in FIG. 3, the holder 120 is integrally provided with a pair of mounting portions 124, at which the two bearing members 110 are mounted, at each of two end portions, along an axial direction of the charging roller 14 and cleaning roller 100 (left and right side end portions in FIG. 3), of a main body portion 122 of the holder 120.

A guide channel 126 is formed in each mounting portion 124 along a direction in which the mounting portion 124 extends. The bearing members 110 are fitted into these guide channels 126, and disposed close to distal end sides thereof. The bearing members 110 are guided in the guide channels 126 and are made capable of sliding along the direction of extension of the mounting portions 124 (i.e., a direction toward and away from the photosensitive drum 12).

A compression coil spring 128 is disposed at a base end side within each guide channel 126. The compression coil springs 128 urge the bearing members 110 toward the photosensitive drum 12. By spring force of the compression coil springs 128, the bearing members 110 are urged toward the photosensitive drum 12 (i.e., in the direction of arrow 8), and the charging roller 14 is abutted against the photosensitive drum 12.

Figure 5:
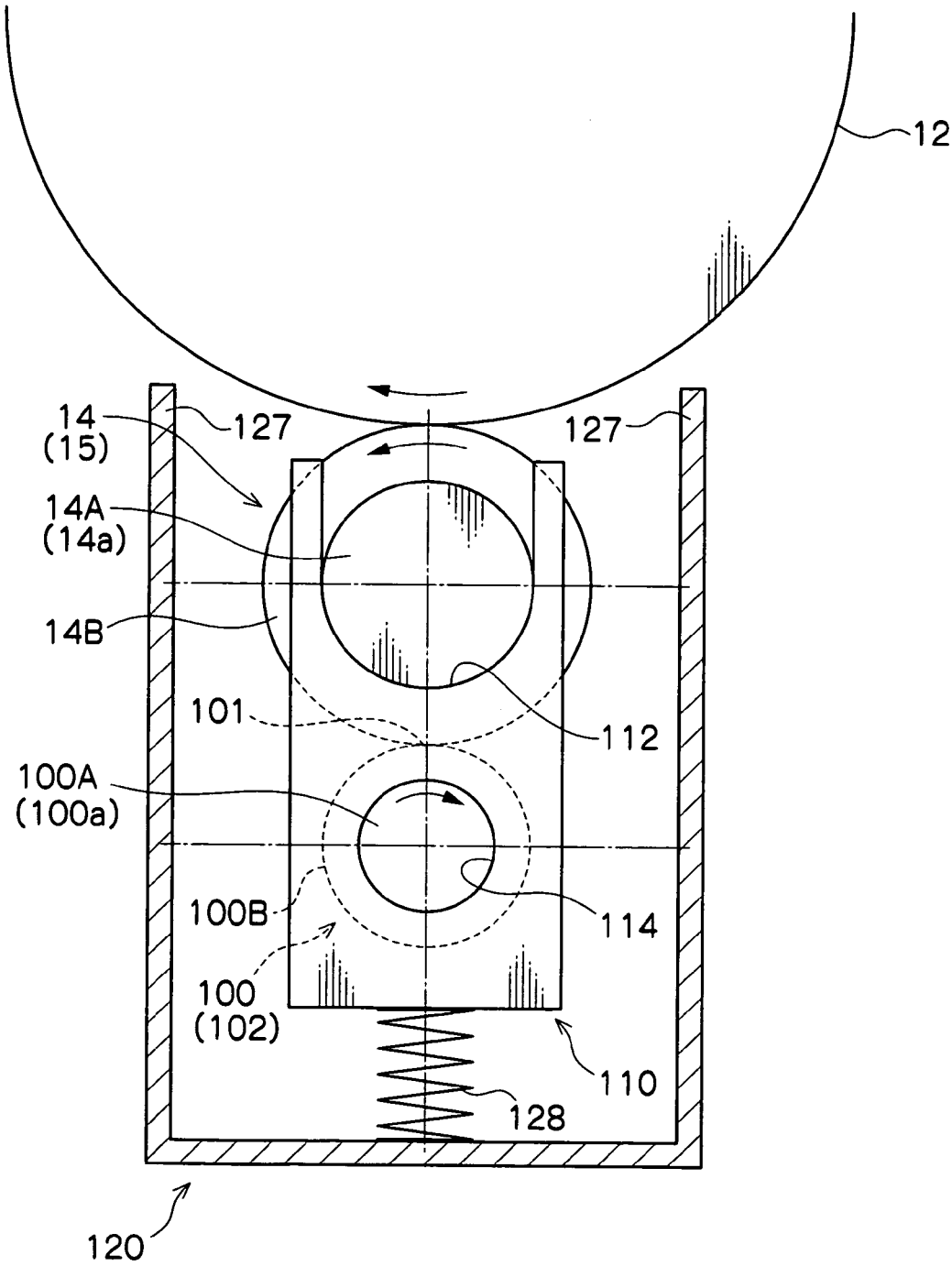
FIG. 5 is a partial sectional side view showing the state in which the charging roller and the cleaning roller according to the embodiment of the present invention are axially supported at the bearing member.

Thus, at the pair of bearing members 110, between the charging roller 14 of which the support portions 14*a* at the two ends of the shaft 14A are coaxially supported and the cleaning roller 100 of which the support portions 100*a* at the two ends of the shaft 100A are supported, as described above, the cleaning roller 100 is pushed against the charging roller 14 with a predetermined loading, the sponge layer 100B resiliently deforms along the peripheral surface of the charging roller 14, and the nipping portion 101 is formed (see FIG. 2). In this state, an inter-axis separation of the charging roller 14 and the cleaning roller 100 is fixed, and a relative spacing in the direction of abutting is kept constant. Furthermore, a positional relationship in a direction intersecting the abutting direction (substantially a direction of a contacting portion (the nipping portion 101)) is fixed, and relative positions are kept constant. Consequently, a width of nipping is constant. Further, as shown in FIG. 5, the photosensitive drum 12 side of the holder 120, which covers the surroundings of the charging roller 14 and the cleaning roller 100, is open (the upper side of FIG. 5), and in the state in which the holder 120 supports the rollers, 14 and 100, a gap is formed between an upper edge portion 127 thereof and the photosensitive drum 12.

As shown in FIGS. 3 and 4, at the charging roller 14 of the present exemplary embodiment, a pair of first auxiliary rollers 15 are coaxially mounted to vicinities of the two end portions of the shaft 14A. In addition, at the cleaning roller 100, a pair of second auxiliary rollers 102, which correspond with the two first auxiliary rollers 15, are coaxially mounted to vicinities of the two end portions of the shaft 100A.

Figure 6:
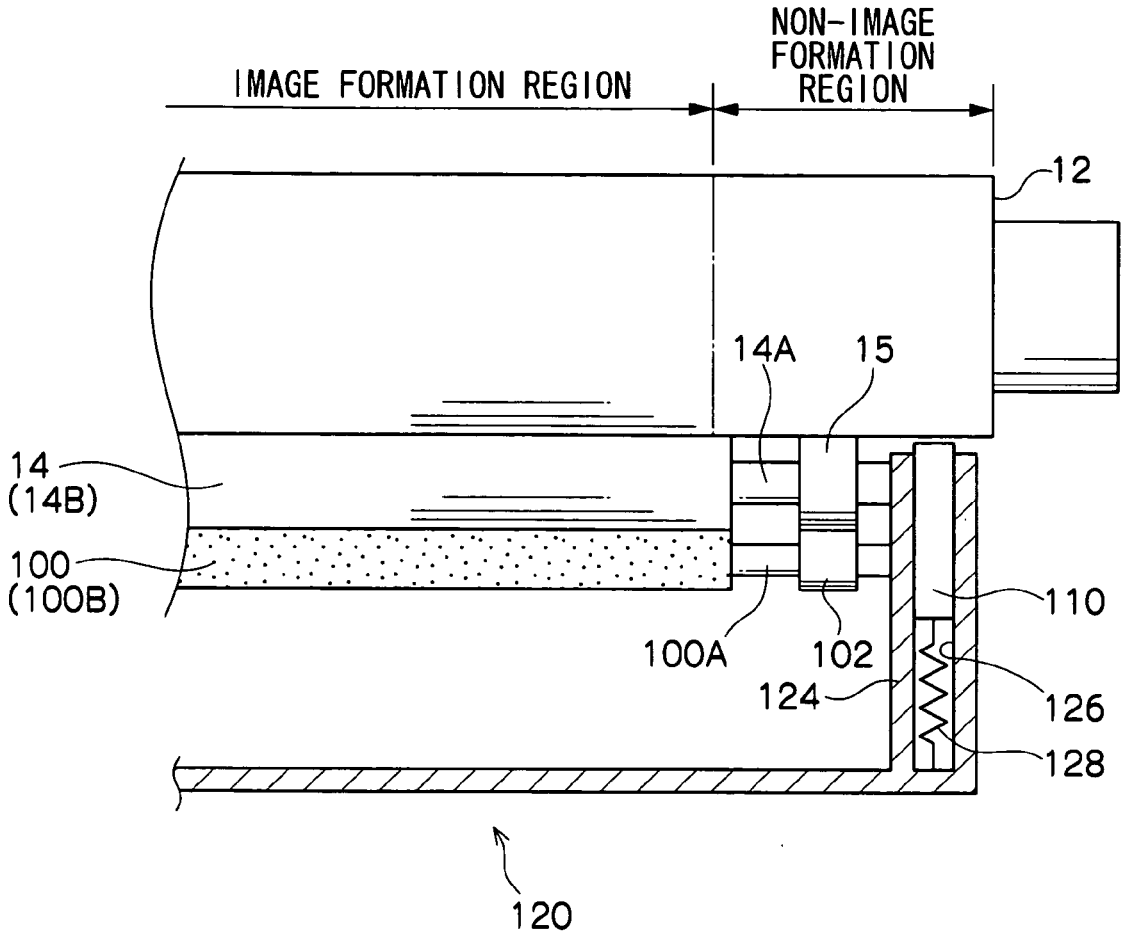
FIG. 6 is an enlarged view, corresponding with FIG. 3, showing mounting positions of the auxiliary rollers according to the embodiment of the present invention.

Each first auxiliary roller 15 is slightly spaced apart from the charging layer 14B at the vicinity of the end portion of the shaft 14A, and is fixed at a position so as not to contact the bearing member 110. Furthermore, as shown in FIG. 6, the first auxiliary roller 15 is located outside an image formation region of the photosensitive drum 12 (i.e., at a non-image-formation region), and is disposed well away from the image formation region.

The first auxiliary roller 15 has an outer diameter the same as an outer diameter of the charging roller 14 (i.e., of the charging layer 14B), or is set to be slightly larger. Thus, the first auxiliary roller 15 contacts the surface of the photosensitive drum 12. Further, with the first auxiliary rollers 15 of the present embodiment, a friction force between the first auxiliary rollers 15 and the photosensitive drum 12 is specified so as to be larger than a friction force between the photosensitive drum 12 and the charging roller 14.

More specifically, a resilient force of the surfaces of the first auxiliary rollers 15 is set larger than a resilient force of the surface of the charging roller 14, or the outer diameter of the first auxiliary rollers 15 is set larger than the outer diameter of the charging roller 14, or the first auxiliary rollers 15 are formed of a material with a higher coefficient of friction against the photosensitive drum 12 than the charging roller 14 (i.e., the charging layer 14B), a coating with a higher coefficient of friction against the photosensitive drum 12 than the charging roller 14 (the charging layer 14B) is applied to the surfaces of the first auxiliary rollers 15, or the like. Thus, the first auxiliary rollers 15 are specified such that the relationship (friction force between the first auxiliary rollers 15 and the photosensitive drum 12)>(friction force between the photosensitive drum 12 and the charging roller 14) is satisfied.

Meanwhile, each second auxiliary roller 102 is slightly spaced apart from the sponge layer 100B at the vicinity of the end portion of the shaft 100A, and is fixed at a position so as not to contact the bearing member 110. Furthermore, as shown in FIG. 6, the second auxiliary roller 102 is located to correspond with the first auxiliary roller 15 outside the image formation region of the photosensitive drum 12 (at the non-image-formation region) and, similarly to the first auxiliary roller 15, is disposed well apart from the image formation region.

The second auxiliary roller 102 has an outer diameter the same as an outer diameter of the cleaning roller 100 (i.e., the sponge layer 100B), or is set slightly larger. Thus, the second auxiliary roller 102 contacts the surface of the first auxiliary roller 15, and a width dimension (i.e., axial direction dimension) of the second auxiliary roller 102 is set substantially the same as a width dimension of the first auxiliary roller 15.

Further, with the second auxiliary rollers 102 of the present embodiment, a friction force between the first auxiliary rollers 15 and the second auxiliary rollers 102 is specified so as to be smaller than the friction force between the first auxiliary rollers 15 and the photosensitive drum 12, equal to or greater than the friction force between the photosensitive drum 12 and the charging roller 14, and greater than a friction force between the charging roller 14 and the cleaning roller 100.

More specifically, the outer diameter of the second auxiliary rollers 102 is set larger than the outer diameter of the cleaning roller 100, or the second auxiliary rollers 102 are formed of a material with which a coefficient of friction of the second auxiliary rollers 102 against the first auxiliary rollers 15 is smaller than the coefficient of friction between the first auxiliary rollers 15 and the photosensitive drum 12, is equal to or greater than the coefficient of friction between the photosensitive drum 12 and the charging roller 14 and is greater than a coefficient of friction between the charging roller 14 and the cleaning roller 100, or a coating which achieves the above coefficient of friction relationships is applied to the surfaces of the second auxiliary rollers 102, or the like. Thus, the second auxiliary rollers 102 are specified such that the relationships (friction force between the first auxiliary rollers 15 and the photosensitive drum 12)>(friction force between the first auxiliary rollers 15 and the second auxiliary rollers 102)≧(friction force between the photosensitive drum 12 and the charging roller 14)>(friction force between the charging roller 14 and the cleaning roller 100) are satisfied.

Next, operations of the present embodiment will be described.

In the image formation device 10 of the present embodiment, when the photosensitive drum 12 rotates during an image formation operation, the charging roller 14 is rotated in accordance with the rotation of the photosensitive drum 12, and electrostatically charges the photosensitive drum 12. The cleaning roller 100 is also rotated in accordance with the rotation of the charging roller 14, and cleans the charging roller 14. Thus, the charging roller 14 which charges up the photosensitive drum 12 for image formation is cleaned of extraneous matter that has adhered to the roller surface thereof by the cleaning roller 100, and decreases in charging capabilities are consequently restrained. Further, because the surroundings of the charging roller 14, along with the cleaning roller 100, are covered by the holder 120, except at the side at which the photosensitive drum 12 is disposed, the charging roller 14 is protected from toner, dust and the like that flies from the developers 18Y, 18M, 18C and 18K and floats around in the device 10, and adherence of such extraneous matter is prevented.

The rotation of the charging roller 14 which contacts the photosensitive drum 12 and is rotated is assisted by the pair of first auxiliary rollers 15, which are provided coaxially with respect to the charging roller 14, contacting the photosensitive drum 12 and being rotated together with the charging roller 14. Further, because the friction force between the first auxiliary rollers 15 and the photosensitive drum 12 is made larger than the friction force between the photosensitive drum 12 and the charging roller 14 and the friction force between the charging roller 14 and the cleaning roller 100 is made smaller than the friction force between the photosensitive drum 12 and the charging roller 14, even when deterioration with time of the surface of the charging roller 14 progresses over a long period of use, a decrease in drivability of the charging roller 14 with respect to the photosensitive drum 12 is suppressed. Therefore, stable charging characteristics can be maintained over long periods. Moreover, because the first auxiliary rollers 15 are disposed outside the image formation region of the photosensitive drum 12, adverse effects on image formation are avoided.

Because, as mentioned above, the resilient force of the surfaces of the first auxiliary rollers 15 is made smaller than the resilient force of the surface of the charging roller 14 or the outer diameter of the first auxiliary rollers 15 is made to be equal to or greater than the outer diameter of the charging roller 14, the relationship (friction force between the first auxiliary rollers 15 and the photosensitive drum 12)>(friction force between the photosensitive drum 12 and the charging roller 14) can be realized with a simple structure.

With a structure in which, as in the present embodiment, the cleaning roller 100 is in contact with the charging roller 14 and follows rotation thereof, there is concern that the friction force between the cleaning roller 100 and the charging roller 14 will fall, because of a deterioration over time of the surface of the cleaning roller 100 due to long-term usage of the image formation device 10 or the like, and that drivability of the cleaning roller 100 by the charging roller 14 will fall, causing cleaning failures.

However, the rotation of the cleaning roller 100 of the present embodiment to follow the charging roller 14 is assisted by the pair of second auxiliary rollers 102, which are coaxially provided, contacting the first auxiliary rollers 15 provided at the charging roller 14 and being rotated together with the cleaning roller 100. Further, because the friction force between the first auxiliary rollers 15 and the second auxiliary rollers 102 is made smaller than the friction force between the first auxiliary rollers 15 and the photosensitive drum 12, a fall in drivability of the charging roller 14 with respect to the photosensitive drum 12 can be avoided, and because the friction force between the first auxiliary rollers 15 and the second auxiliary rollers 102 is made larger than the friction force between the charging roller 14 and the cleaning roller 100 (i.e., is set to at least the friction force between the photosensitive drum 12 and the charging roller 14), the rotation of the cleaning roller 100 caused by the rotation of the charging roller 14 can be excellently assisted. Therefore, even when deterioration with time of the surface of the cleaning roller 100 progresses over a long period of use, a decrease in drivability of the cleaning roller 100 by the charging roller 14 is suppressed, and stable charging characteristics can be maintained over long periods.

Moreover, because, as mentioned above, the outer diameter of the second auxiliary rollers 102 is set to at least the outer diameter of the cleaning roller 100, the relationship (friction force between the first auxiliary rollers 15 and the second auxiliary rollers 102) (≧(friction force between the photosensitive drum 12 and the charging roller 14))>(friction force between the charging roller 14 and the cleaning roller 100) can be realized with a simple structure.

Thus, with the image formation device 10 of the present embodiment, image defects due to failures in charging of the photosensitive drum 12 and failures in cleaning of the charging roller 14 are suppressed, and high quality images can be formed over long periods.

Hereinabove, the present invention has been described in detail in accordance with the particular exemplary embodiment described above. However, the present invention is not limited to this exemplary embodiment, and it is possible to embody various modes within the scope of the present invention.

For example, the exemplary embodiment described above has a structure in which the charging roller 14 and the cleaning roller 100 are both supported by the bearing members 110, and the charging roller 14 is abutted against the photosensitive drum 12 and the cleaning roller 100 is abutted against the charging roller 14 by the urging force of the compression coil springs 128. However, support structures, abutting structures and the like of the respective rollers 14 and 100 are not limited thereto; the charging roller 14 and the cleaning roller 100 could be supported by separate bearing members, and could be urged for abutting by separate urging means.

Further, although the charging roller 14 contacts a lower side portion of the photosensitive drum 12 and the cleaning roller 100 contacts a lower side portion of the charging roller 14 in the above structure, positional relationships of the photosensitive drum 12, the charging roller 14 and the cleaning roller 100 are not limited thereto. For example, the present invention can be applied to a structure in which a charging roller is caused to contact an upper side portion of a photosensitive drum and a cleaning roller is caused to contact an upper side portion of a charging roller, or the like.

Further again, an image formation device 10 to which the present invention is applied is not limited to a four cycle-type structure which repeats formation of toner images onto the photosensitive drum 12 four times using the rotating developing unit 18, as in the present embodiment. For example, with a full-color tandem structure in which image formation units for yellow, magenta, cyan and black are arranged in a row along a direction of movement of an intermediate conveyance belt, the present invention can be applied to a photosensitive drum and a holder of a charging roller and a cleaning roller at each image formation unit.

While the present invention has been illustrated and described with respect to some specific exemplary embodiments thereof, it is to be understood that the present invention is by no means limited thereto and encompasses all changes and modifications which will become possible without departing from the spirit and scope of the present invention.

What is claimed is:

1. An image formation device comprising:

an image-bearing body that rotates;

a charging roller that contacts the image-bearing body and is rotated by the rotation of the image-bearing body, and charges the image-bearing body;

a cleaning roller that contacts the charging roller and is rotated by the rotation of the charging roller, and cleans the charging roller; and a first auxiliary roller that is provided coaxially with the charging roller, contacts the image-bearing body and is rotated by the rotation of the image-bearing body, wherein the image formation device satisfies the following relation:

$$F1>F2>F3$$

where F1 represents a friction force between the first auxiliary roller and the image-bearing body, F2 represents a friction force between the image-bearing body and the charging roller and F3 represents a friction force between the charging roller and the cleaning roller.

2. The image formation device of claim 1, further comprising a second auxiliary roller that is provided coaxially with the cleaning roller, contacts the first auxiliary roller and is rotated by the rotation of the first auxiliary roller, wherein the image formation device satisfies the following relation:

$$F1>F4\geqq F2>F3$$

where F1 represents a friction force between the first auxiliary roller and the image-bearing body, F4 represents a friction force between the first auxiliary roller and the second auxiliary roller, F2 represents a friction force between the image-bearing body and the charging roller and F3 represents a friction force between the charging roller and the cleaning roller.

3. The image formation device of claim 2, wherein the device satisfies the following relation:

$$R1>R2$$

where R1 represents a resilient force of a surface of the charging roller and R2 represents a resilient force of a surface of the first auxiliary roller.

4. The image formation device of claim 2, wherein the device satisfies the following relation:

$$D1\geqq D2$$

where D1 represents an external diameter of the first auxiliary roller and D2 represents an external diameter of the charging roller.

5. The image formation device of claim 2, wherein the device satisfies the following relation:

$$X1\geqq X2$$

where X1 represents an external diameter of the second auxiliary roller and X2 represents an external diameter of the cleaning roller.

6. The image formation device of claim 5, wherein the first auxiliary roller is disposed outside an image formation region of the image-bearing body.

7. The image formation device of claim 2, wherein the first auxiliary roller is disposed outside an image formation region of the image-bearing body.

8. The image formation device of claim 1, wherein the device satisfies the following relation:

$$R1>R2$$

where R1 represents a resilient force of a surface of the charging roller and R2 represents a resilient force of a surface of the first auxiliary roller.

9. The image formation device of claim 8, wherein the device satisfies the following relation:

$$D1 \geqq D2$$

where D1 represents an external diameter of the first auxiliary roller and D2 represents an external diameter of the charging roller.

10. The image formation device of claim 8, wherein the first auxiliary roller is disposed outside an image formation region of the image-bearing body.

11. The image formation device of claim 1, wherein the device satisfies the following relation:

$$D1 \geqq D2$$

where D1 represents an external diameter of the first auxiliary roller and D2 represents an external diameter of the charging roller.

12. The image formation device of claim 11, wherein the first auxiliary roller is disposed outside an image formation region of the image-bearing body.

13. The image formation device of claim 1, wherein the first auxiliary roller is disposed outside an image formation region of the image-bearing body.

* * * * *